US007617789B2

(12) United States Patent
Simard et al.

(10) Patent No.: US 7,617,789 B2
(45) Date of Patent: Nov. 17, 2009

(54) REAR PLATFORM GEOMETRY

(75) Inventors: Richard Simard, St-Charles de Drummond (CA); Francois Giroux, Valcourt (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 11/948,434

(22) Filed: Nov. 30, 2007

(65) Prior Publication Data

US 2009/0139437 A1 Jun. 4, 2009

(51) Int. Cl.
*B63B 35/73* (2006.01)

(52) U.S. Cl. ..... 114/55.57; 114/55.51

(58) Field of Classification Search ..... 114/55.51, 114/55.53, 55.57, 55.5, 55.55
See application file for complete search history.

(56) References Cited

U.S. PATENT DOCUMENTS 4,893,579 A * 1/1990 Kobayashi ..... 114/55.57
4,945,852 A * 8/1990 Kobayashi ..... 114/55.57
5,050,517 A * 9/1991 Kobayashi ..... 114/55.57
5,676,086 A * 10/1997 Watkins ..... 114/55.53
6,375,527 B2 * 4/2002 Gohara ..... 114/55.57
6,553,928 B2 * 4/2003 Yamada et al. ..... 114/55.51
6,651,573 B2 * 11/2003 Aselton et al. ..... 114/55.57
2001/0000052 A1 * 3/2001 Yamada et al. ..... 114/55.53

* cited by examiner

*Primary Examiner*—Lars A Olson
(74) *Attorney, Agent, or Firm*—Osler, Hoskin & Harcourt LLP

(57) ABSTRACT

A personal watercraft is disclosed having a hull and a sub-deck together forming a hull and sub-deck (HSD) assembly. Left and right gunnels have generally vertical inner walls. The HSD assembly has a pedestal disposed on a longitudinal centerline of the watercraft generally between the forward portion of the left inner wall and the forward portion of the right inner wall. The pedestal has generally vertical left and right lateral walls. Left and right side channels are defined between the lateral walls of the pedestal and the forward portions of the inner walls. A rear channel is defined between the rearward portions of the left and right inner walls, and is disposed rearwardly of the pedestal on the longitudinal centerline of the watercraft. The width of the rear channel is narrower than the width of the pedestal. A personal watercraft having only a hull and a deck is also disclosed.

19 Claims, 16 Drawing Sheets

REAR PLATFORM GEOMETRY

FIELD OF THE INVENTION

The present invention relates to personal watercraft, in particular to the rear platform geometry of a personal watercraft.

BACKGROUND OF THE INVENTION

Most of today's commercially available personal watercraft have a hull and a deck disposed directly thereon. The deck has a pedestal onto which a straddle-type seat is disposed. While operating the watercraft, the driver and passengers sit on the seat and place their feet in footrests formed in recessed portions of the deck.

In an effort to minimize the transfer of these forces to the driver and passengers, some watercraft have a suspension element, such as a spring and damper assembly, disposed between the seat and the deck. Although this reduces the transfers of these forces to the body of the driver and passengers, this arrangement still tends to solicit the legs of the driver and passengers since the seat now moves relative to the footrests formed in the deck.

Another way to minimize the transfer of these forces to the driver and passengers consists in suspending the whole deck above the hull. The engine, fuel tank, and propulsion system are still in and/or connected to the hull. A sub-deck is disposed on the hull to protect the components in the hull from water. The hull and sub-deck together form a hull and sub-deck (HSD) assembly. The deck is suspended on the HSD assembly. In this arrangement, the footrest can still be formed with the deck, and as such the legs of the drivers and passengers are less solicited than in watercraft where only the seat is suspended. In this arrangement, the HSD assembly may have recesses designed to accommodate the footrests that are formed with the deck.

When recessed portions are formed in the deck or HSD assembly for the purpose of providing footrests, these recessed portions are prone to filling up with water during operation of the watercraft. If the water is allowed to remain in the recessed portions, it can decrease rider comfort and adversely affect the buoyancy and therefore the handling characteristics of the watercraft. In addition, as water enters the watercraft it increases the weight of the watercraft, thereby reducing the buoyancy of the watercraft, which in turn lowers the watercraft relative to the water level and makes additional water more likely to enter the watercraft, thereby exacerbating the problem.

In typical watercraft having only a deck mounted to the hull, the water is allowed to exit the recessed portions over the rear deck. While this is an adequate arrangement for some watercraft, it has some drawbacks. In order for the water to exit the recessed portions at a sufficient rate, the rear deck is generally made as low as possible. In this arrangement, it is possible for water to enter the recessed portions over the rear deck, for example when the watercraft is operated in reverse or when a wave hits the back of the watercraft, or when the watercraft tilts during turning or when a rider boards the watercraft from one side and a lateral edge of the rear deck dips below the waterline.

Therefore, there is a need for a personal watercraft wherein the amount of water entering the watercraft during operation of the watercraft is reduced.

SUMMARY OF THE INVENTION

It is an object of the present invention to ameliorate at least some of the inconveniences present in the prior art.

It is also an object of the present invention to provide a personal watercraft wherein the amount of water entering the watercraft during operation of the watercraft is reduced.

In one aspect, the invention provides a personal watercraft comprising a hull. A sub-deck is disposed on the hull. The hull and sub-deck together form a hull and sub-deck (HSD) assembly. The HSD assembly has upwardly-extending left and right gunnels. The left gunnel has a generally vertical left inner wall. The right gunnel has a generally vertical right inner wall. Each inner wall has a forward portion and a rearward portion. The HSD assembly has a pedestal disposed on a longitudinal centerline of the watercraft. The pedestal is disposed generally between the forward portion of the left inner wall and the forward portion of the right inner wall. The pedestal has a generally vertical left lateral wall and a generally vertical right lateral wall. The left lateral wall and the right lateral wall define therebetween a width of the pedestal. An engine is disposed in the HSD assembly. A propulsion system is connected to the hull and operatively connected to the engine. A helm assembly is operatively connected to the propulsion system. A straddle-type seat is disposed above the pedestal of the HSD assembly at least in part rearwardly of the helm assembly. A left side channel is defined between the left lateral wall of the pedestal and the forward portion of the left inner wall. A right side channel is defined between the right lateral wall of the pedestal and the forward portion of the right inner wall. A rear channel is defined between the rearward portion of the left inner wall and the rearward portion of the right inner wall. The rear channel is disposed rearwardly of the pedestal on the longitudinal centerline of the watercraft. The rear channel is generally symmetric about the longitudinal centerline of the watercraft. A width of the rear channel is narrower than a maximum width of the pedestal.

In a further aspect, a rear platform is connected to a rear portion of the HSD assembly. The rear platform extends laterally across the rear portion of the HSD assembly above the rear channel.

In a further aspect, the width of the rear channel is narrower than a minimum width of the pedestal.

In a further aspect, a left storage compartment is disposed to the left of the rear channel and rearward of the left side channel. A right storage compartment is disposed to the right of the rear channel and rearward of the right side channel.

In a further aspect, the rear channel has a generally horizontal bottom wall. The left and right storage compartments are disposed at least in part higher than the bottom wall of the rear channel.

In a further aspect, the left side channel has a generally horizontal bottom wall. The right side channel has a generally horizontal bottom wall. The rear channel has a generally horizontal bottom wall. The bottom wall of the rear channel is higher than the bottom walls of the left and right side channels.

In a further aspect, when the personal watercraft is placed in water at rest and with no load placed thereon, the bottom walls of the left and right side channels are below a waterline of the watercraft. The bottom wall of the rear channel is above the waterline of the watercraft.

In a further aspect, a deck is disposed above the sub-deck. The straddle-type seat is disposed on the deck.

In a further aspect, the deck has left and right footrests disposed laterally outwardly of the seat. The left footrest is disposed in the left side channel above the bottom wall of the left side channel. The right footrest is disposed in the right side channel above the bottom wall of the right side channel.

In a further aspect, a suspension element has a first portion connected to the deck and a second portion connected to the HSD assembly. The suspension element permits relative movement between the deck and the HSD assembly.

In a further aspect, the HSD assembly further comprises a recess forward of the side channels. The recess provides fluid communication between the side channels therethrough.

In a further aspect, a check valve is disposed in the rear channel. The check valve permits water to flow out of the watercraft via the rear channel. The check valve prevents water from flowing into the watercraft via the rear channel.

In another aspect, the invention provides a personal watercraft comprising a hull. A deck is disposed on the hull. The deck and the hull define therebetween an engine compartment. The deck has upwardly-extending left and right gunnels. The left gunnel has a generally vertical left inner wall. The right gunnel has a generally vertical right inner wall. Each inner wall has a forward portion and a rearward portion. The deck has a pedestal disposed on a longitudinal centerline of the watercraft. The pedestal is disposed generally between the forward portion of the left inner wall and the forward portion of the right inner wall. The pedestal has a generally vertical left lateral wall and a generally vertical right lateral wall. The left lateral wall and the right lateral wall define therebetween a width of the pedestal. An engine is disposed in the engine compartment. A propulsion system is connected to the hull and operatively connected to the engine. A helm assembly is operatively connected to the propulsion system. A straddle-type seat is disposed above the pedestal at least in part rearwardly of the helm assembly. A left side channel is defined between the left lateral wall of the pedestal and the forward portion of the left inner wall. A right side channel is defined between the right lateral wall of the pedestal and the forward portion of the right inner wall. A rear channel is defined between the rearward portion of the left inner wall and the rearward portion of the right inner wall. The rear channel is disposed rearwardly of the pedestal on the longitudinal centerline of the watercraft. The rear channel is generally symmetric about the longitudinal centerline of the watercraft. A width of the rear channel is narrower than a maximum width of the pedestal.

In a further aspect, a rear platform is connected to a rear portion of the deck. The rear platform extends laterally across the rear portion of the deck above the rear channel.

In a further aspect, the width of the rear channel is narrower than a minimum width of the pedestal.

In a further aspect, a left storage compartment is disposed to the left of the rear channel and rearward of the left side channel. A right storage compartment is disposed to the right of the rear channel and rearward of the right side channel.

In a further aspect, the rear channel has a generally horizontal bottom wall. The left and right storage compartments are disposed at least in part higher than the bottom wall of the rear channel.

In a further aspect, the left side channel has a generally horizontal bottom wall. The right side channel has a generally horizontal bottom wall. The rear channel has a generally horizontal bottom wall. The bottom wall of the rear channel is higher than the bottom walls of the left and right side channels.

In a further aspect, when the personal watercraft is placed in water at rest and with no load placed thereon, the bottom walls of the left and right side channels are below a waterline of the watercraft. The bottom wall of the rear channel is above the waterline of the watercraft.

In a further aspect, the deck has left and right footrests disposed laterally outwardly of the seat. The left footrest is disposed in the left side channel. The right footrest is disposed in the right side channel.

In a further aspect, the deck further comprises a recess forward of the side channels. The recess provides fluid communication between the side channels therethrough.

In a further aspect, a check valve is disposed in the rear channel. The check valve permits water to flow out of the watercraft via the rear channel. The check valve prevents water from flowing into the watercraft via the rear channel.

For purposes of this application, terms related to spatial orientation such as forwardly, rearwardly, left, and right, are as they would normally be understood by a driver of the vehicle sitting thereon in a normal riding position. Also, the term "laterally inwardly" means toward the longitudinal centerline of the vehicle and the term "laterally outwardly" means away from the longitudinal centerline of the vehicle.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
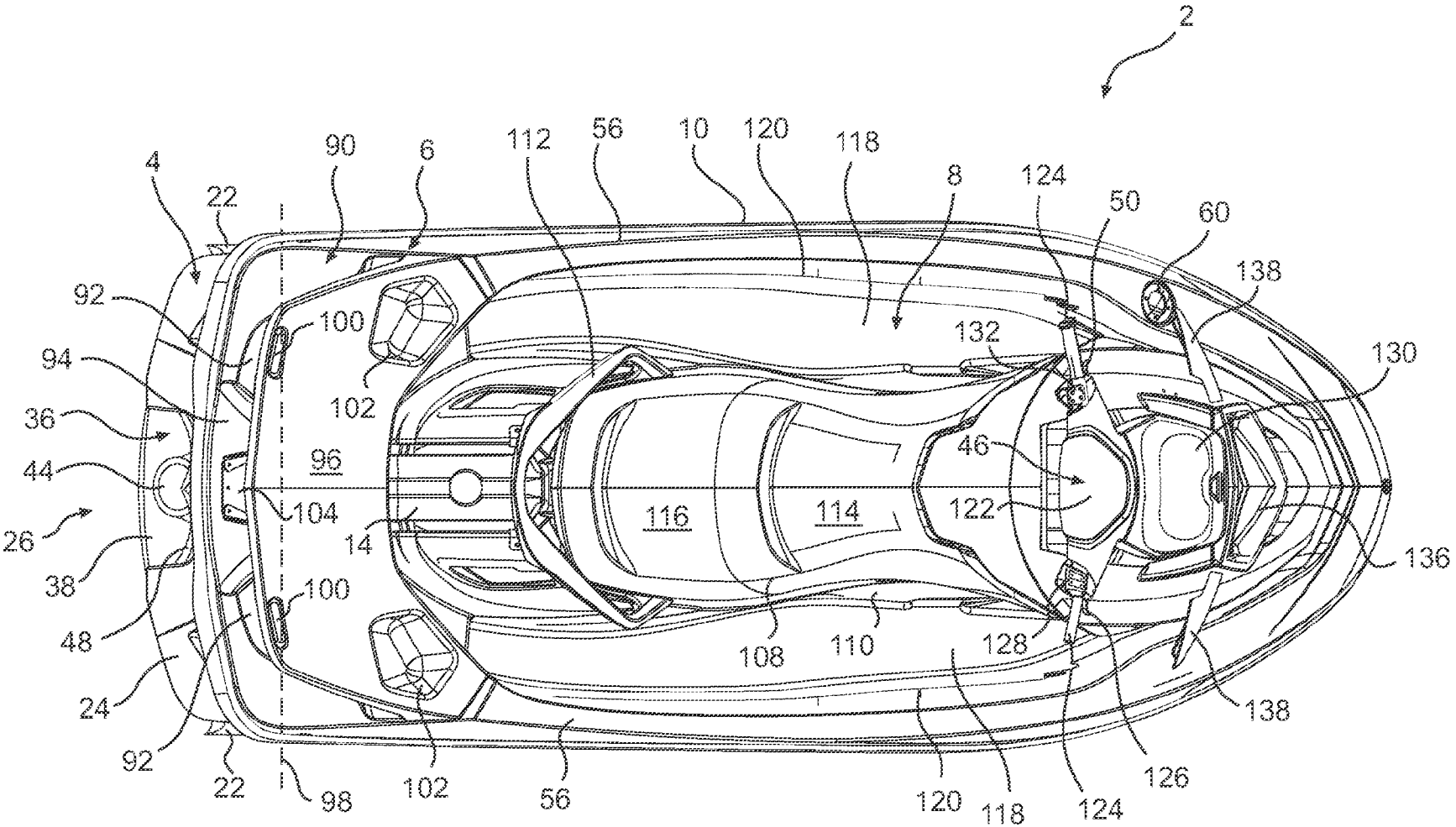
FIG. 5 is a perspective view, taken from a top, rear side, of the watercraft of FIG. 1.
Figure 6:
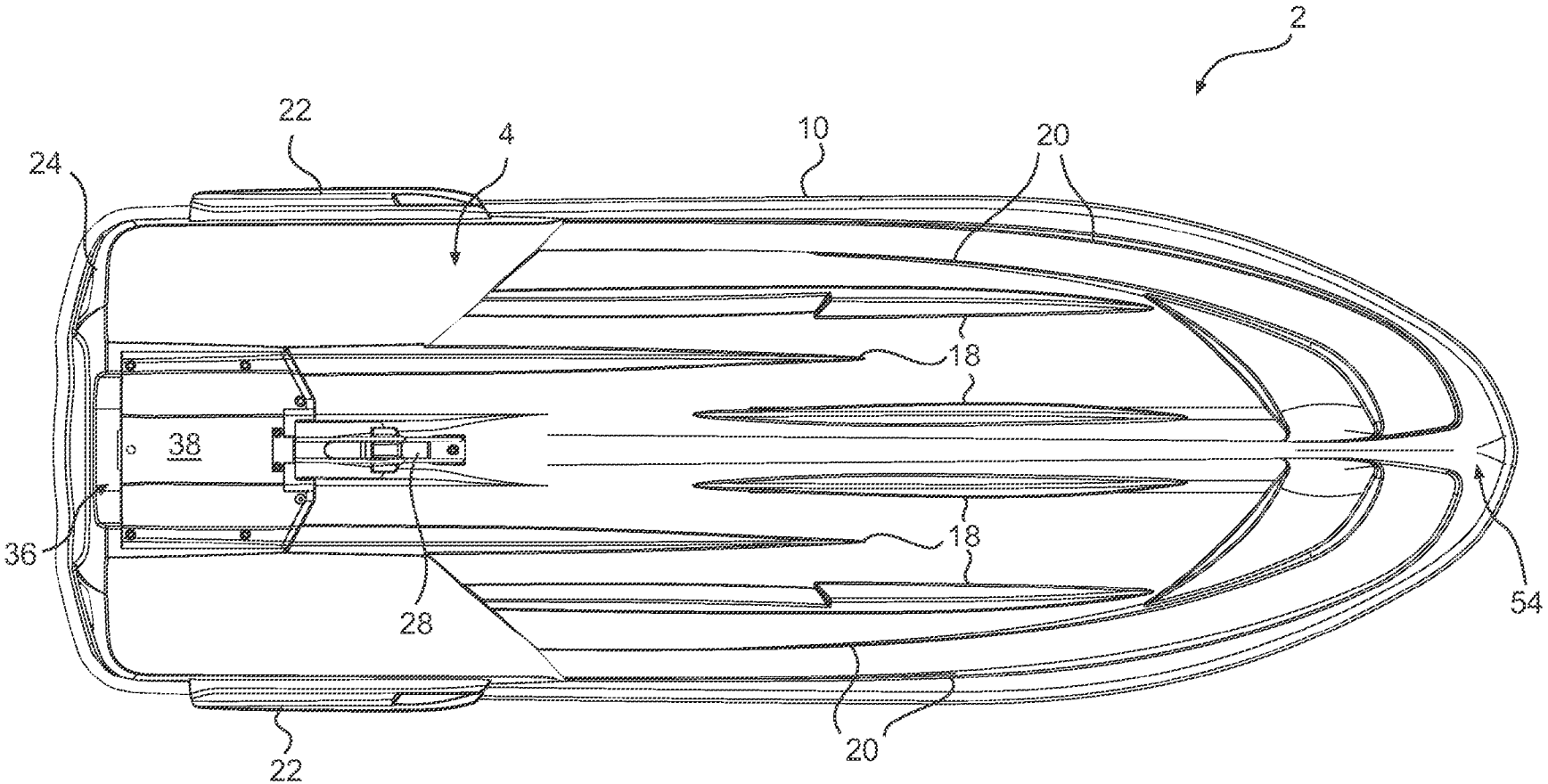
FIG. 6 is a bottom plan view of the watercraft of FIG. 1.
Figure 7:
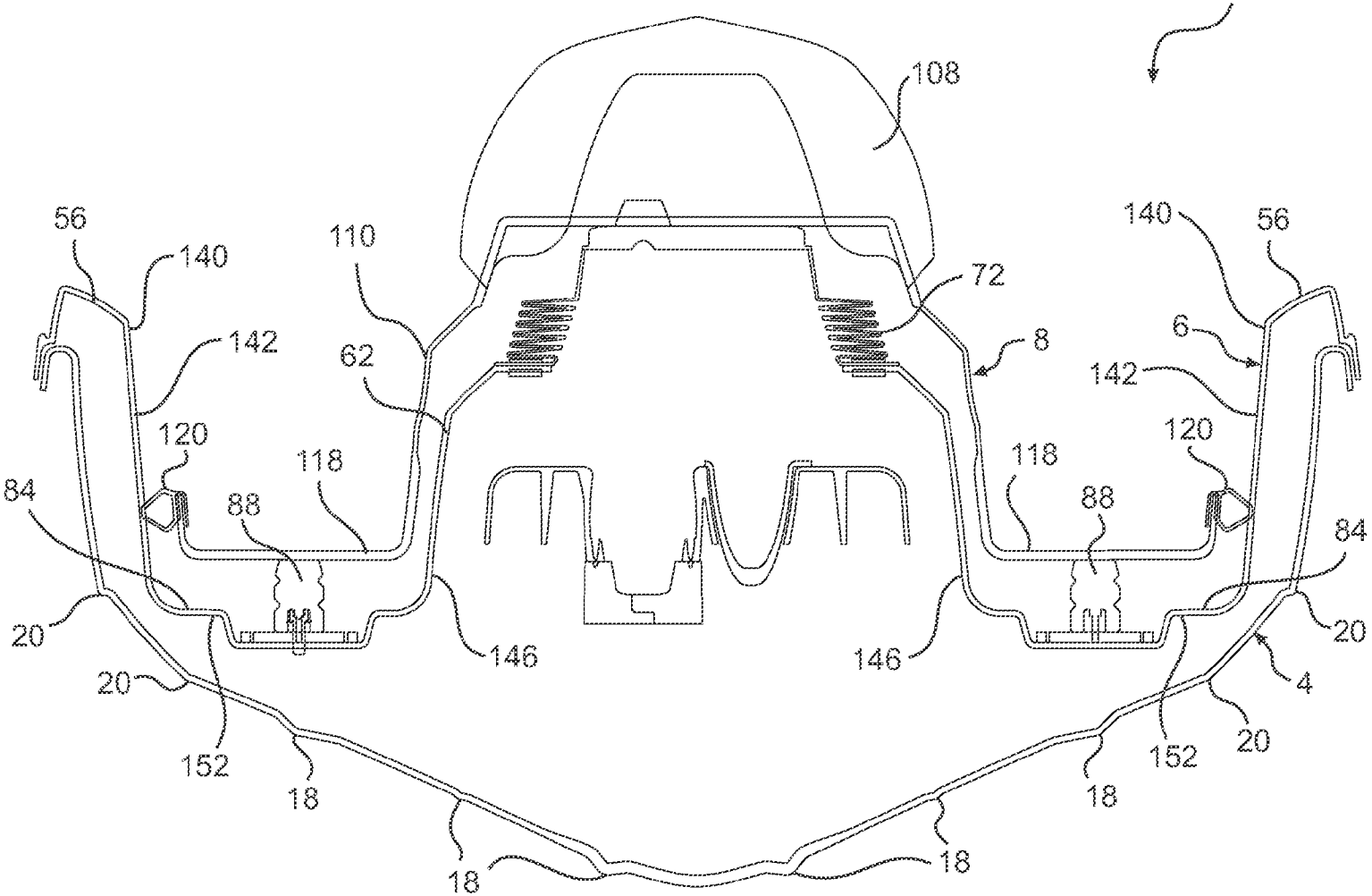
FIG. 7 is a schematic view of a transverse cross-section of the watercraft of FIG. 1.
Figure 8:
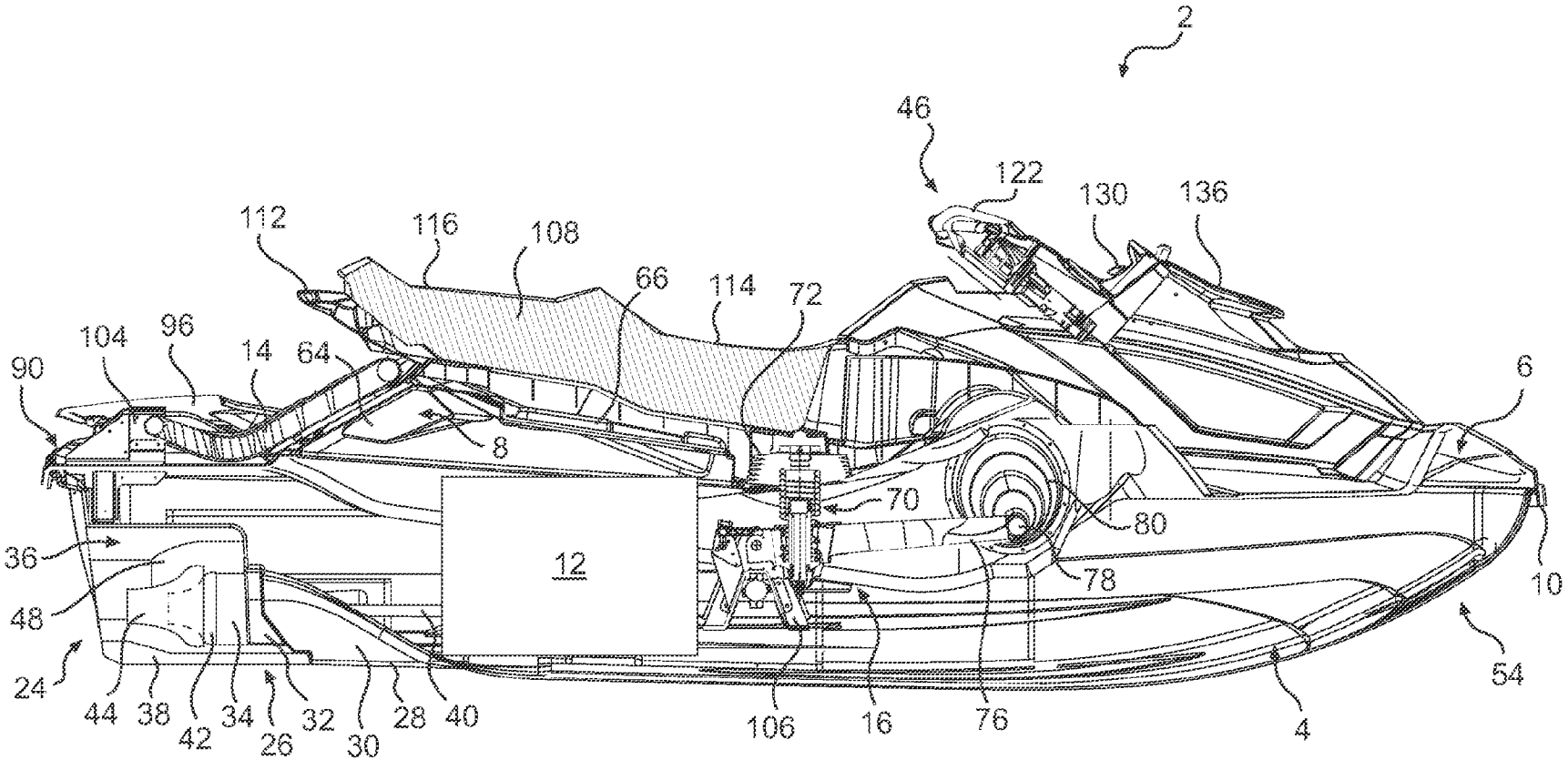
FIG. 8 is a partial longitudinal cross-section of the watercraft of FIG. 1 showing some of the internal components thereof.
Figure 9:
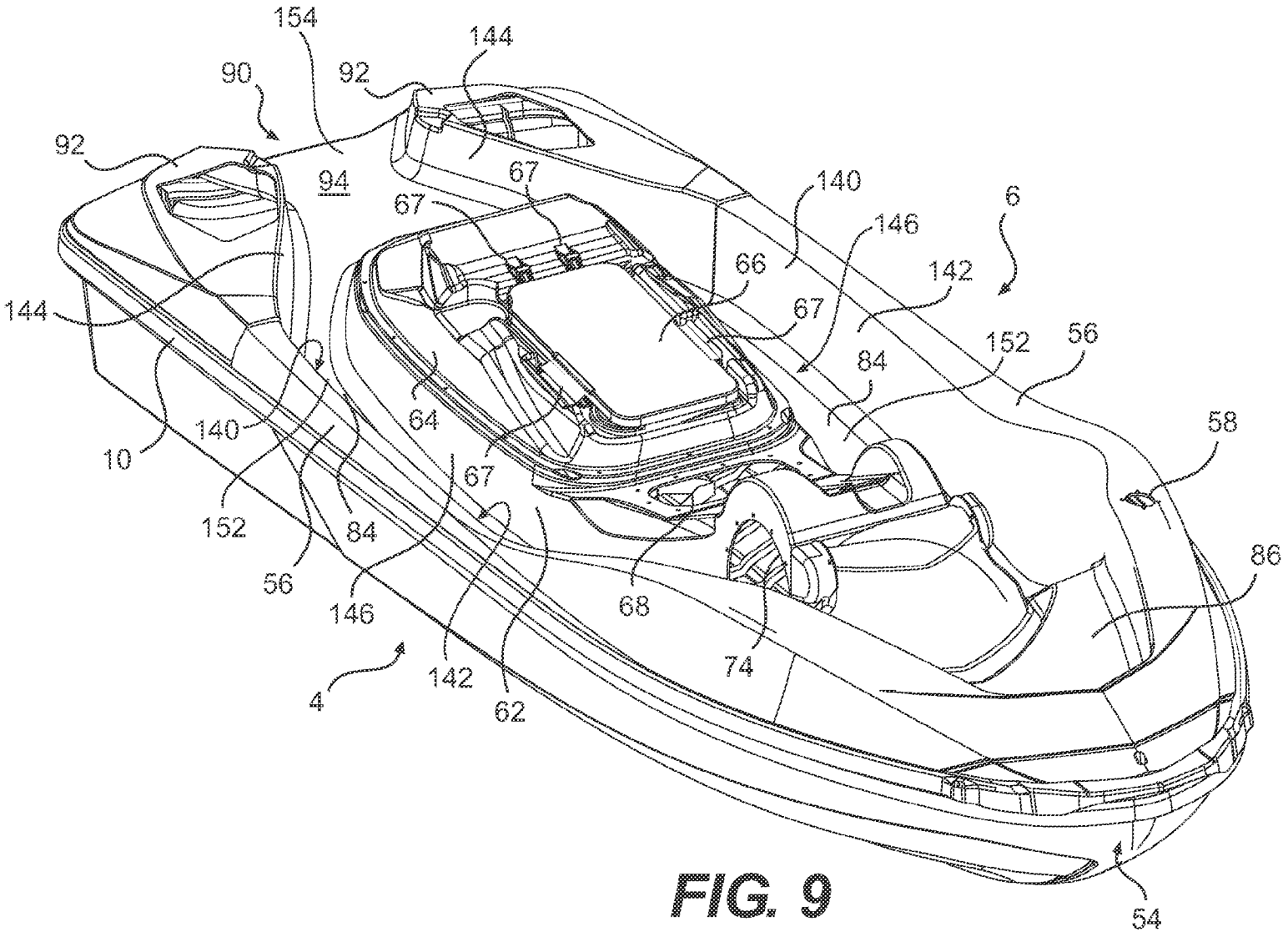
FIG. 9 is a perspective view, taken from a front, right side, of a hull and sub-deck assembly of the watercraft of FIG. 1, with the engine cowling thereon.
Figure 10:
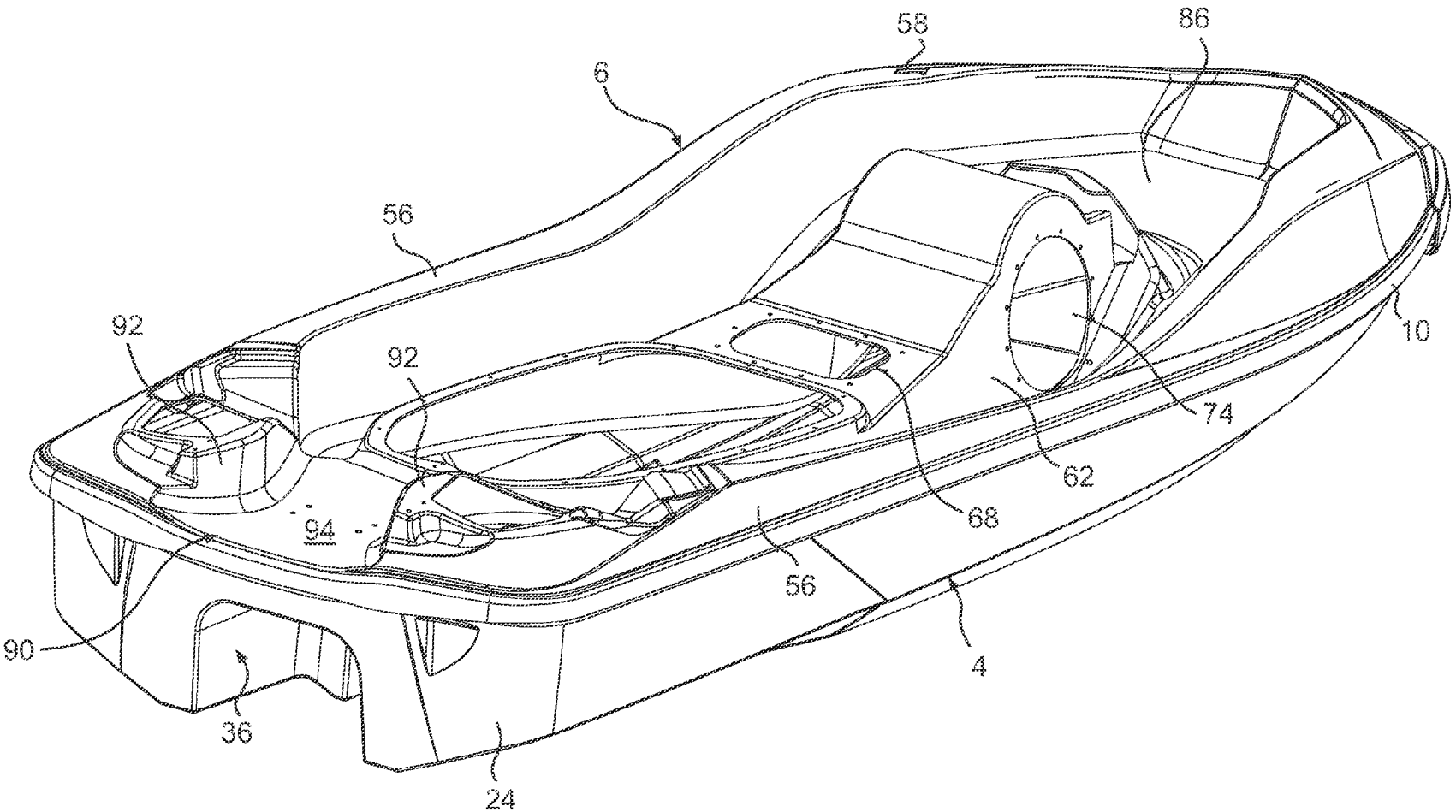
FIG. 10 is a perspective view, taken from a rear, right side, of the hull and sub-deck assembly of FIG. 9, with the engine cowling removed.
Figure 11:
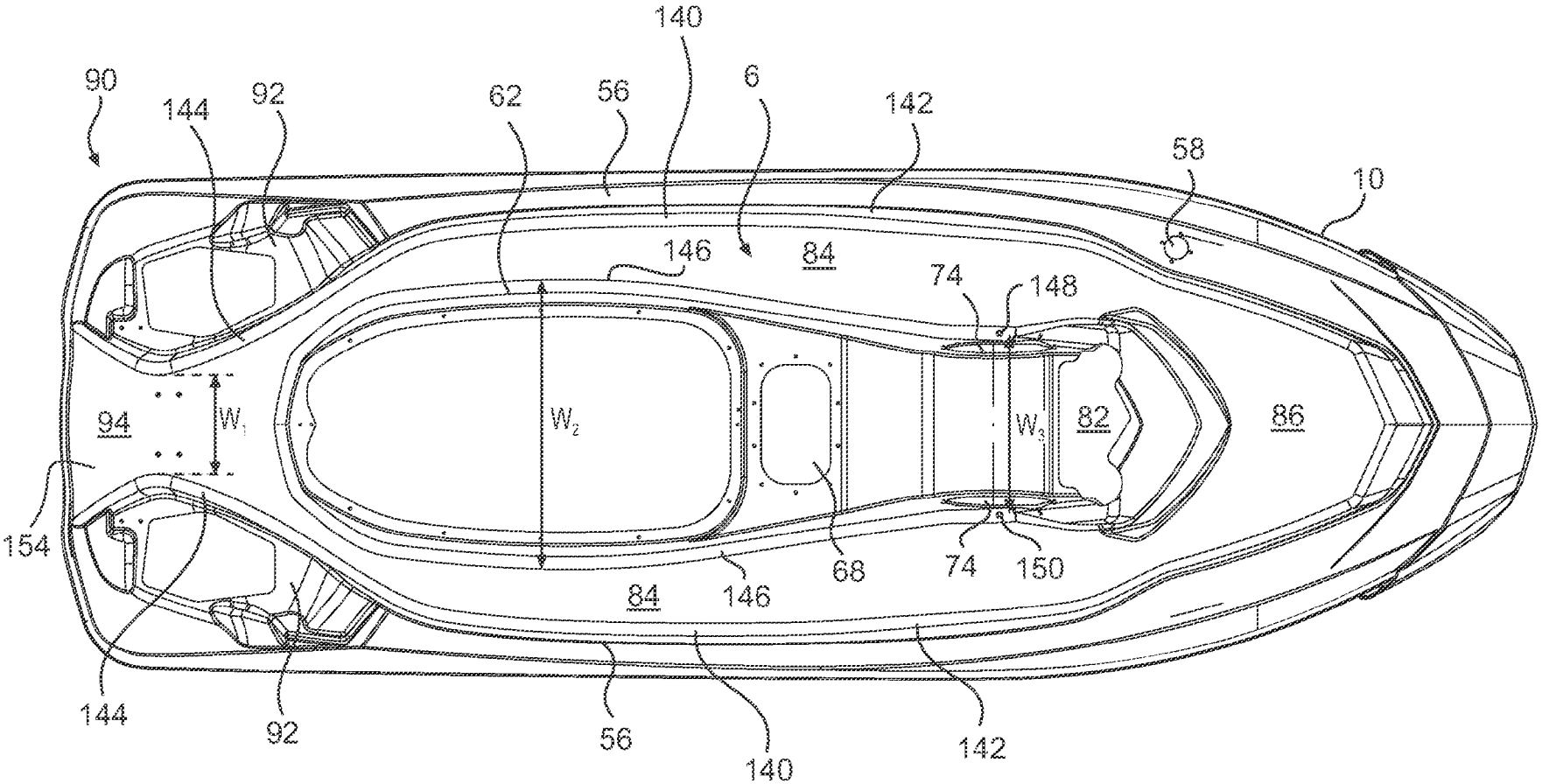
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. It is contemplated that the deck 8 could be fixedly connected to the HSD assembly.

Figure 1:
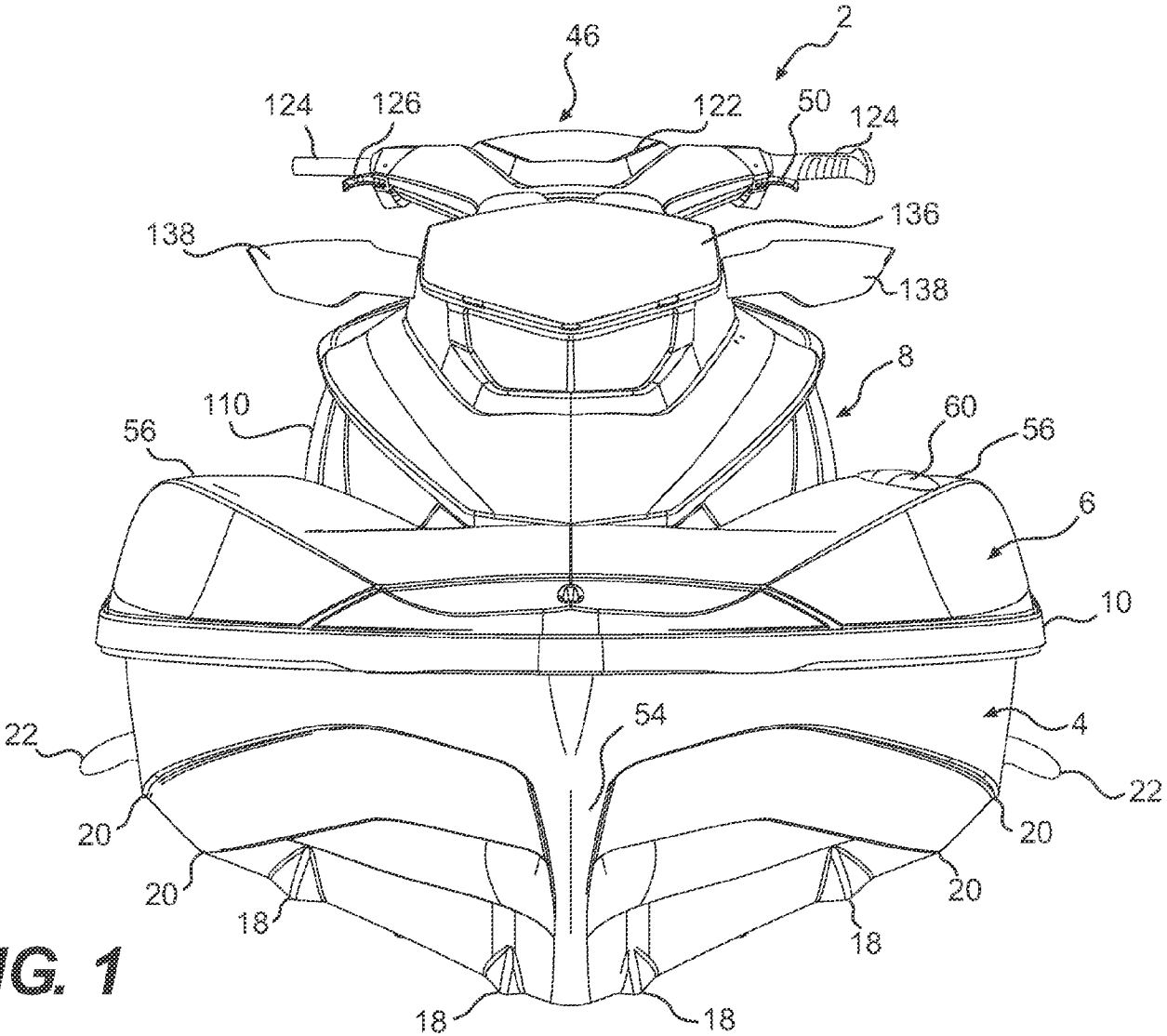
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
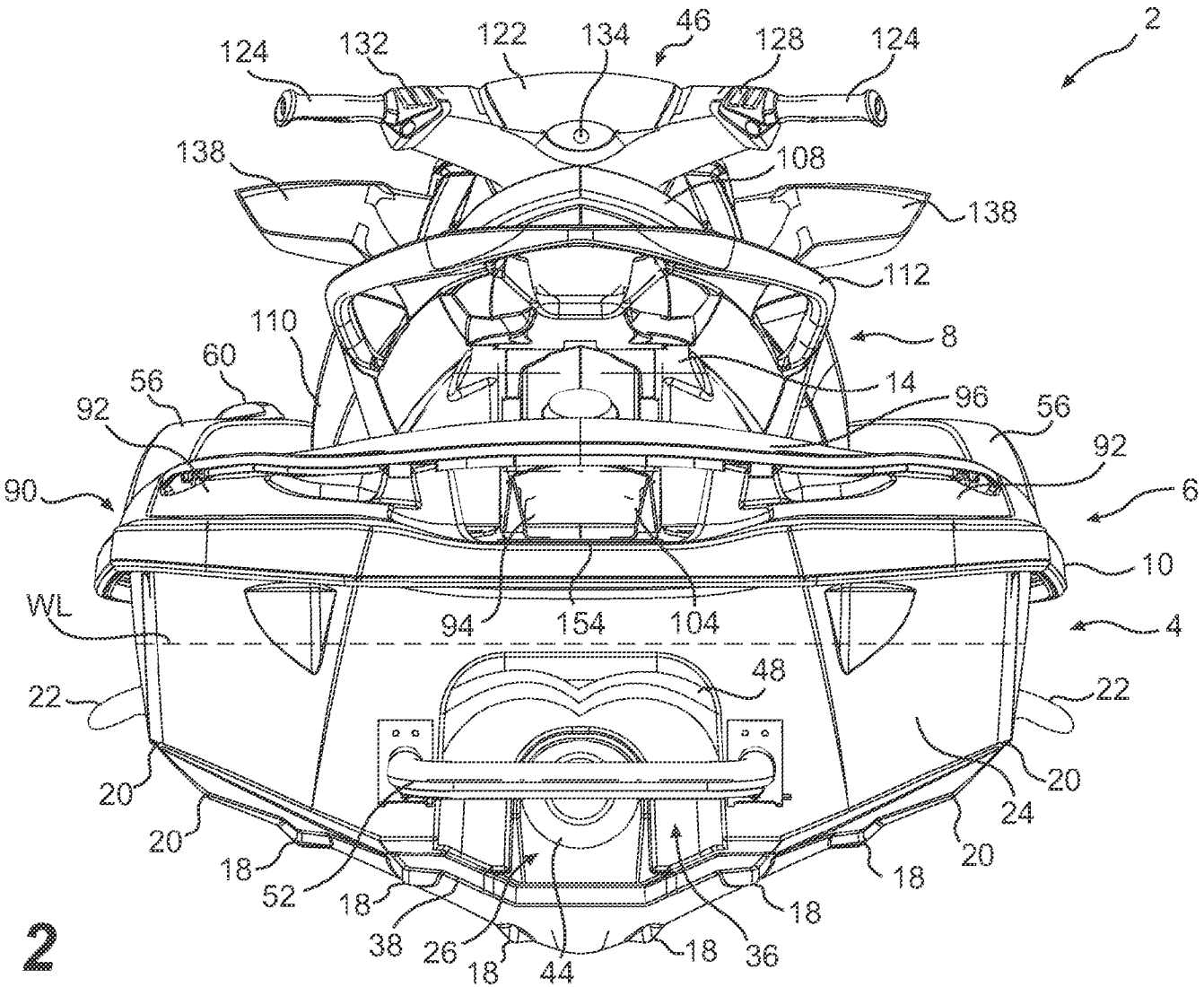
FIG. 2 is a rear elevation view of the watercraft of FIG. 1.
Figure 3:
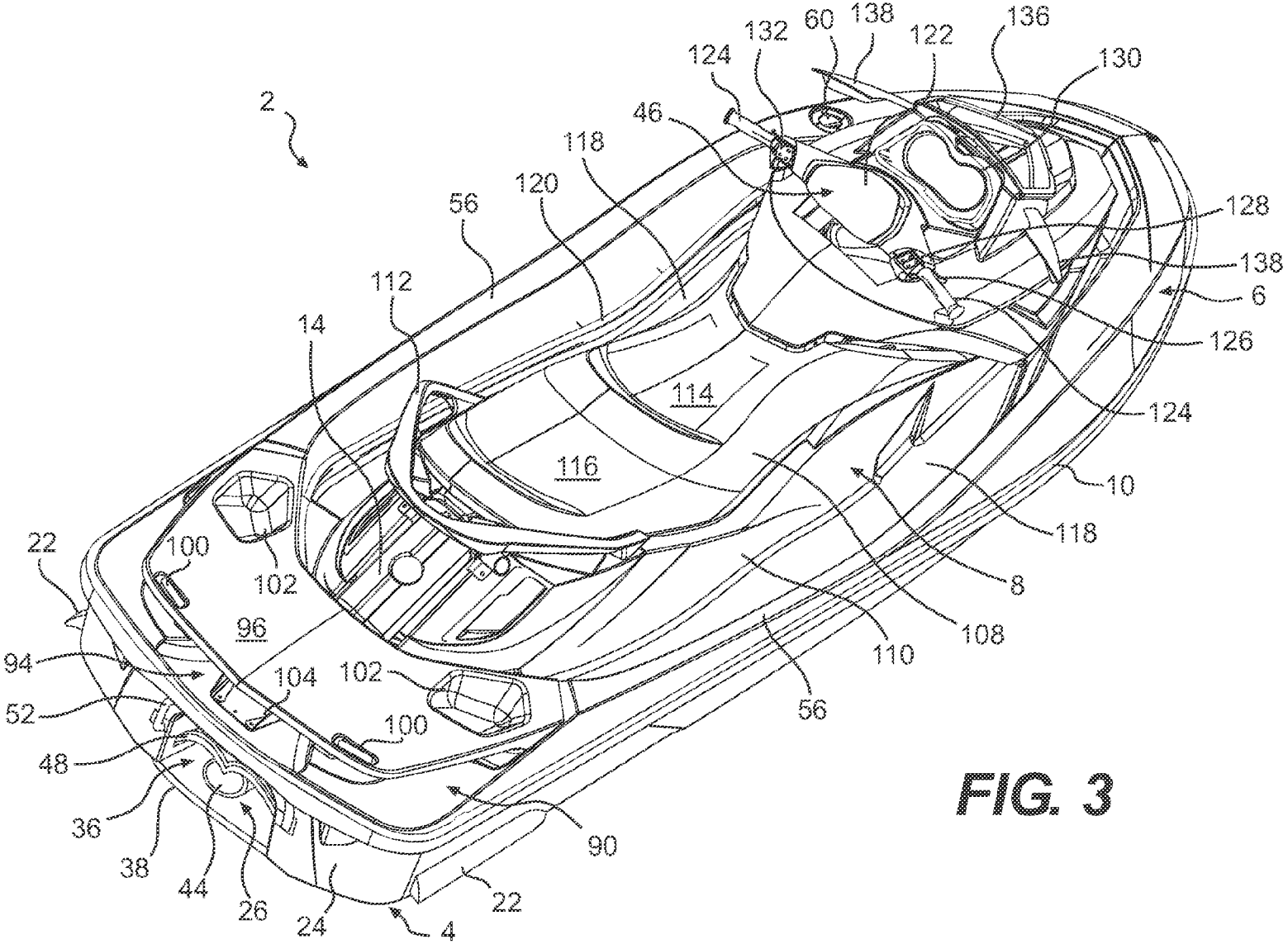
FIG. 3 is a perspective view, taken from a rear, right side, of the watercraft of FIG. 1.
Figure 4:
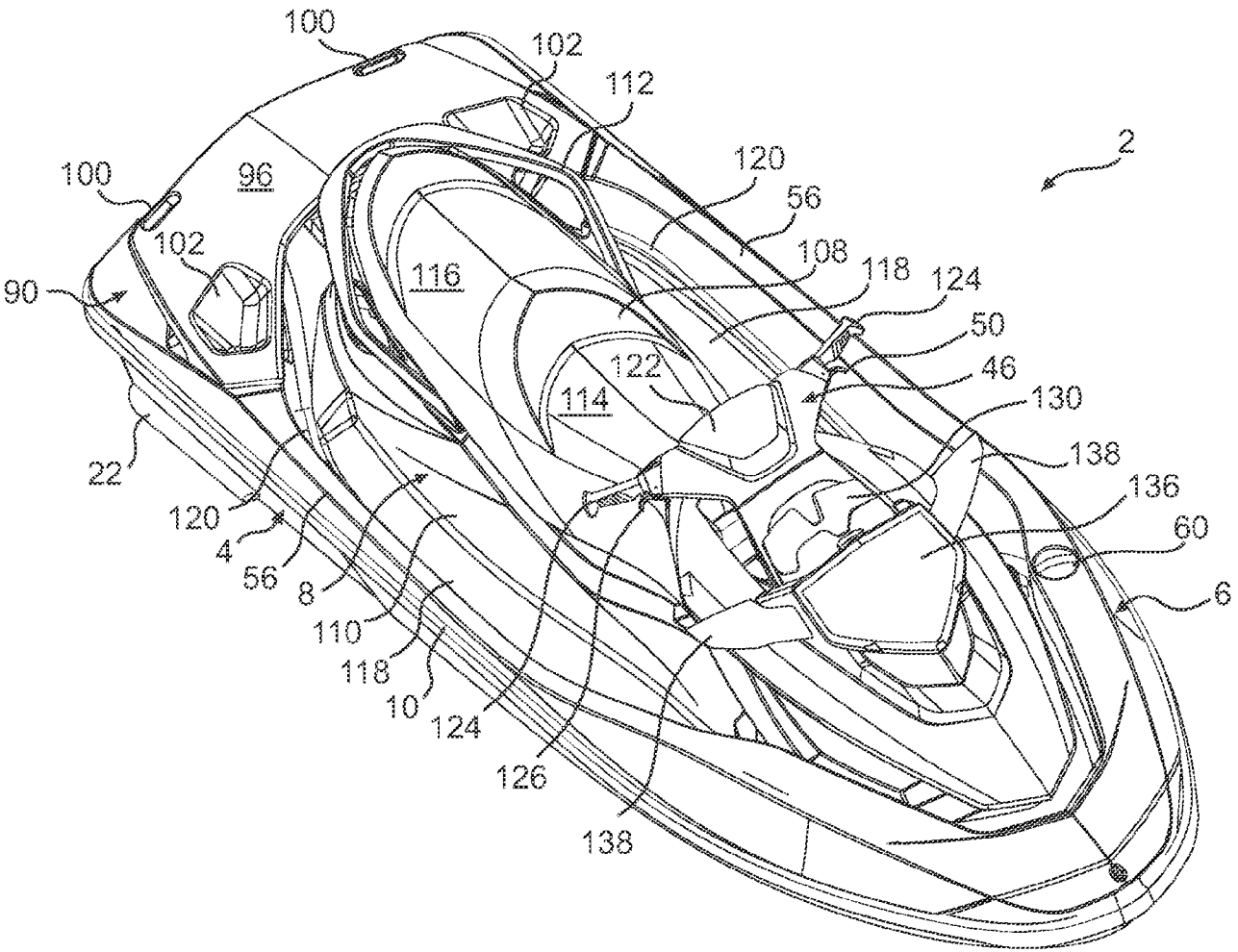
FIG. 4 is a perspective view, taken from a front, right side, of the watercraft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom to facilitate boarding 24 the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refueling opening 58 is provided on the front left gunnel 56. A hose (not shown) extends from the refueling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refuelling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6 and a seal is disposed between the engine cowling 64 and the remainder of the sub-deck 6 to prevent water intrusion. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear portion of the pedestal 62 below the engine cowling 64 to provide an attachment point for towing a water-skier or an inflatable device for example.

An opening 68 is provided in the upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. The suspension elements 70 can include, but are not limited to, one or more springs and a hydraulic damper. It is contemplated that the suspension assembly 16 could include a single suspension element. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on the sides of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are connected to the sub-deck 6 around the openings 74 at one end thereof and are connected around brackets (not shown) attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increase the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94. When the watercraft 2 moves forward, the bow 54 raises, thus raising the side channels 84. This permits any water accumulated in the side channels 84 to drain through the rear channel 94. The side channels 84 and the rear channel 94 will be described below in further detail.

Figure 12:
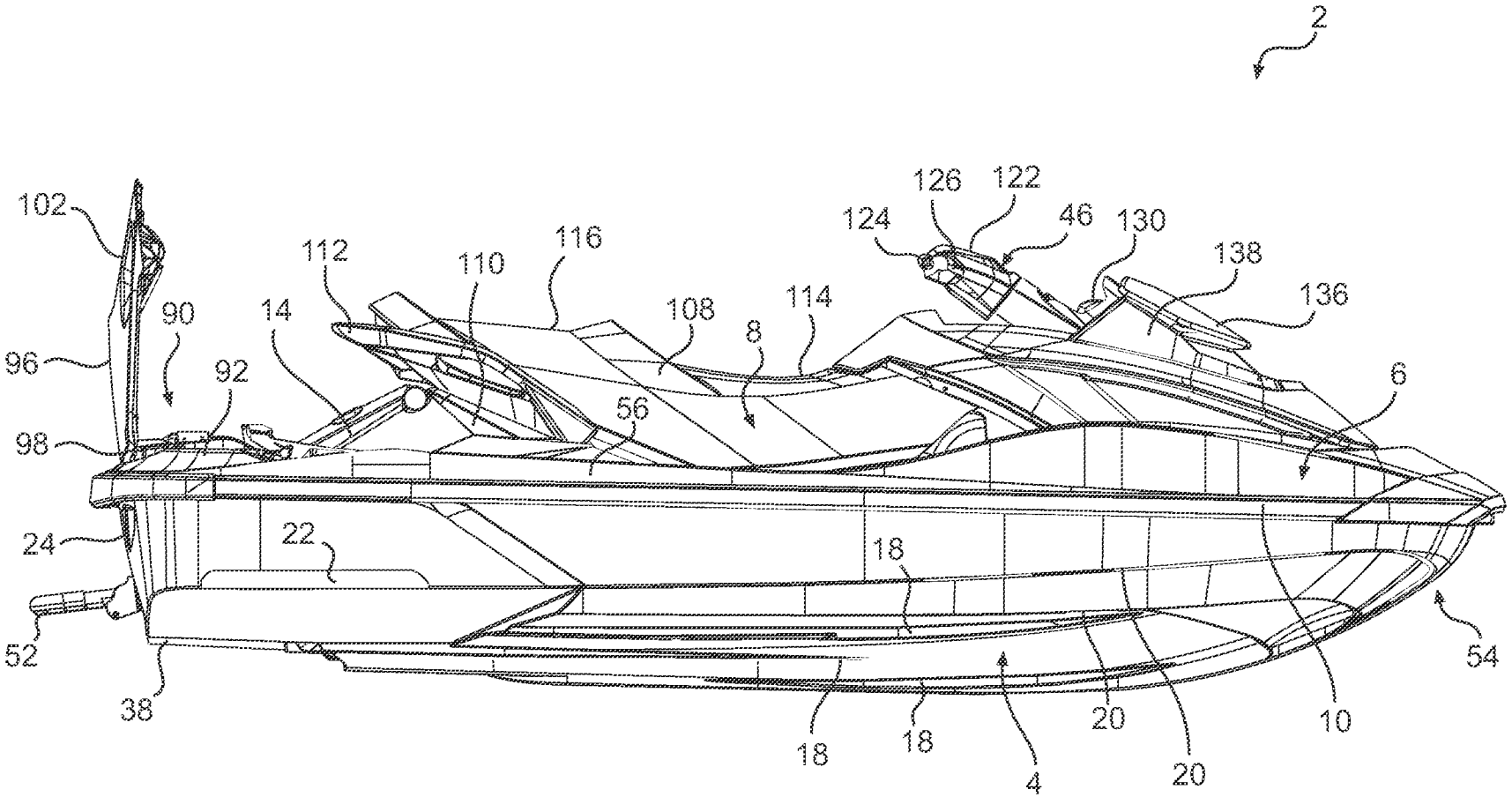
FIG. 12 is a side elevation view of the watercraft of FIG. 1 with a rear platform thereof in a raised position.

A rear platform 96 is pivotally connected on the rear portion 90 of the sub-deck 6. The platform 96 preferably pivots about an axis 98 (FIGS. 5 and 12) located near the transom 24 and extending laterally across the sub-deck 6. It is contemplated that the platform 96 could alternatively pivot about an axis located near the front of thereof and extending laterally across the sub-deck 6. It is also contemplated that the platform 96 could alternatively pivot about an axis extending generally parallel to a longitudinal axis of the watercraft 2 and disposed near a lateral side of the platform 96. When the rear platform 96 is in a raised position, as shown in FIG. 12, it permits access to the storage compartments 92. When the rear platform 96 is in a lowered, horizontal position, as shown in FIGS. 2 to 5, the rear platform 96 closes and seals the storage compartments 92, thus eliminating the need of separate lids to accomplish this function. In the lowered position, the rear platform 96 provides a surface on which the driver or passengers can stand when the watercraft 2 is at rest. Two recesses in the rear platform 96 form hand grips 100 which a person can grab to assist themselves when reboarding the watercraft 2 from the water. Two more recesses in the rear platform 96 form heel rests 102 which a passenger sitting on the watercraft 2 facing rearwardly, for spotting a water-skier being towed by the watercraft 2 for example, can use to place their heels to provide them with additional stability. Carpeting made of a rubber-type material preferably covers the rear platform 96 to provide additional comfort and feet traction on the rear platform 96.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to a bracket 106 on the bottom of the hull 4. Suspension elements 70 are connected at their lower ends to the front suspension arm 76 forwardly of the bracket 106 and extend upwardly to connect to the under side of the deck 8 at their upper ends. The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

As seen in FIGS. 1 to 5, the deck has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a system of linkages and is connected at the rear thereof by a latch assembly (not shown) The seat 108 selectively covers an opening (not shown), defined by a top portion of the pedestal 110, which provides access to the air intake unit 66, which once removed, provides access to the upper portion of the engine 12.

Located on either side of the pedestal 110, between the pedestal 110 and the gunnels 56 of the sub-deck 6, are a pair of generally horizontal footrests 118 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber, that can compress and expand to follow the inner side of the gunnels 56 as the HSD assembly moves relative to the deck 8. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122, that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Turning back to FIGS. 2, 7, 9 and 11 and looking at FIGS. 13 and 14, the side channels 84 and the rear channel 94 will now be described in greater detail, according to a first embodiment of the invention. In places where only the left side channel 84 will be described in detail, it should be understood that the right side channel 84 is a mirror image of the left side channel 84 and operates in substantially the same manner.

Referring to FIG. 9, each gunnel 56 has a generally vertical inner wall 140. A forward portion 142 of the wall 140 is disposed generally laterally outwardly of the pedestal 62, such that the pedestal 62 is generally between the forward portions 142 of the walls 140 of the left and right gunnels 56.

The pedestal 62 of the sub-deck 6 is defined on its lateral sides by generally vertical lateral walls 146 on the left and right sides of the pedestal 62. The left side channel 84 is defined between the left wall 146 and the forward portion 142 of the left wall 140 (FIG. 11). The right side channel 84 is defined between the right wall 146 and the forward portion 142 of the right wall 140. The pedestal 62 has a width that is bounded by the left and right walls 146 in the region between the left and right side channels 84. The width of the pedestal 62 varies between the front and the rear of the pedestal 62. The maximum width W2 of the pedestal 62 is defined in the transverse direction at the widest point of the pedestal 62 that is between the left and right side channels 84. A point 148 is defined on the left wall 146 on the laterally inward side of the left side channel 84 at the portion of the left wall 146 that is closest to the longitudinal centerline of the watercraft 2 where the wall 146 is tangentially parallel to the longitudinal centerline of the watercraft 2. Another point 150 is defined on the right wall 146 on the laterally inward side of the right side channel 84 at the portion of the right wall 146 that is closest to the longitudinal centerline of the watercraft 2 and tangentially parallel to the longitudinal centerline of the watercraft 2. The minimum width W3 of the pedestal 3 is defined as the distance in the transverse direction between the point 148 and the point 150.

Referring now to FIG. 11, the bottom of the left side channel 84 is formed by the generally horizontal bottom wall 152. The rear channel 94 is defined between the rearward portions 144 of the left and right walls 140. The rear channel 94 is positioned generally symmetrically about the longitudinal centerline of the watercraft 2, and is disposed rearwardly of the pedestal 62. The minimum width W1 of the rear channel 94 is defined as the shortest distance in the transverse direction between the rearward portions 144 of the left and right lateral walls 140. The minimum width W1 of the rear channel 94 is narrower than the maximum width W2 of the pedestal 62, and preferably narrower than the minimum width W3 of the pedestal 62, as shown. The height of the rearward portions 144 of the walls 140 and the width W1 of the rear channel 94 allow sufficient space for left and right storage compartments 92 to be positioned rearwardly of the side channels 84 on either side of the rear channel 94. The volume of the storage compartments 92 adds buoyancy and stability to the watercraft 2, particularly when the watercraft 2 is tilted during turning or while it is being boarded from one side (FIG. 14). As previously mentioned, the platform 96 extends laterally across the rear portion of the HSD assembly above the rear channel 94, and above the storage compartments 92.

Figure 13:
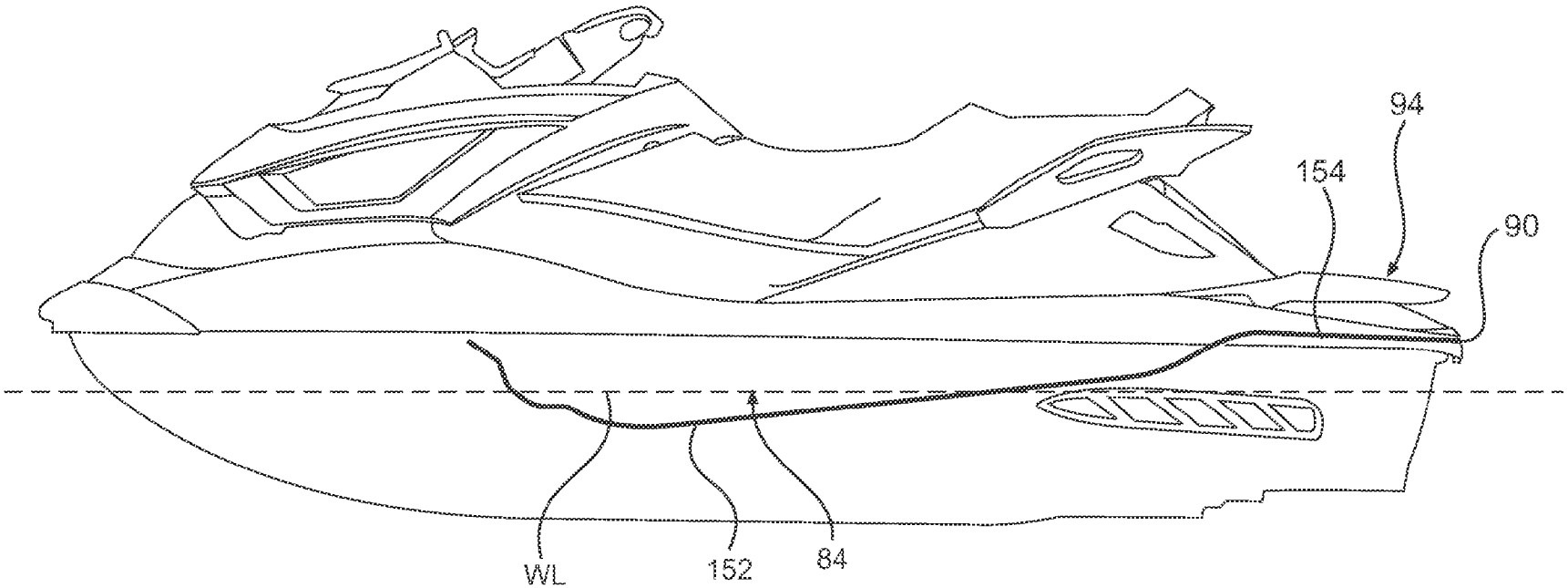
FIG. 13 is a left side elevation view of the watercraft of FIG. 1.

Referring now to FIGS. 2 and 13, a waterline WL of the watercraft 2 is shown. The waterline WL corresponds to the level of water on the watercraft 2 when the watercraft 2 is placed in a body of water at rest and with no load placed thereon. The bottom walls 152 of the left and right side channels 84 are disposed lower than the waterline WL of the watercraft 2 as seen in FIG. 13. The bottom wall 154 of the rear channel 94 is generally horizontal and is disposed higher than the bottom walls 152 and also higher than the waterline WL of the watercraft 2 as seen in FIGS. 2 and 13.

Referring now to FIG. 7, left and right footrests 118 of the deck 8 are disposed laterally outward of the seat 108. The footrests 118 are disposed respectively in the left and right side channels 84, between the respective walls 146 and the forward portions 142 of the respective walls 140 and above the bottom walls 152 of the left and right side channels 84.

When the watercraft 2 is propelled forward by the propulsion system 26, the bow 54 raises relative to the stem. As a result, the side channels 84 are raised to a position higher than the rear channel 94. This permits any water accumulated in the side channels 84 to drain out of the watercraft 2 and into the body of water by flowing through the rear channel 94 and over the rear portion 90 of the sub-deck 6 under the force of gravity. In addition, when the watercraft 2 is accelerating forward, the inertia of the water accumulated in the side channels 84 will cause it to drain out of the watercraft 2 by flowing through the rear channel 94 and over the rear portion 90 of the sub-deck 6 under the force of the acceleration.

When the watercraft 2 is level and not accelerating, the recess 86 forward of the side channels 84 allows any water in the watercraft 2 to flow between the two side channels 84, thereby equalizing the water levels in the side channels 84. This prevents tipping of the watercraft 2 due to uneven water accumulation in either one of the side channels 84. In addition, the equalized water level in the side channels 84 allows water to drain evenly from both side channels 84 through the rear channel 94, thereby making water drainage more efficient.

Also, since the rear portion 90 of the sub-deck 6 is elevated relative to the waterline WL, when the watercraft 2 is operated in the reverse direction, the likelihood of water flowing over the rear platform 90 into the side channels 84 is reduced.

Figure 15:
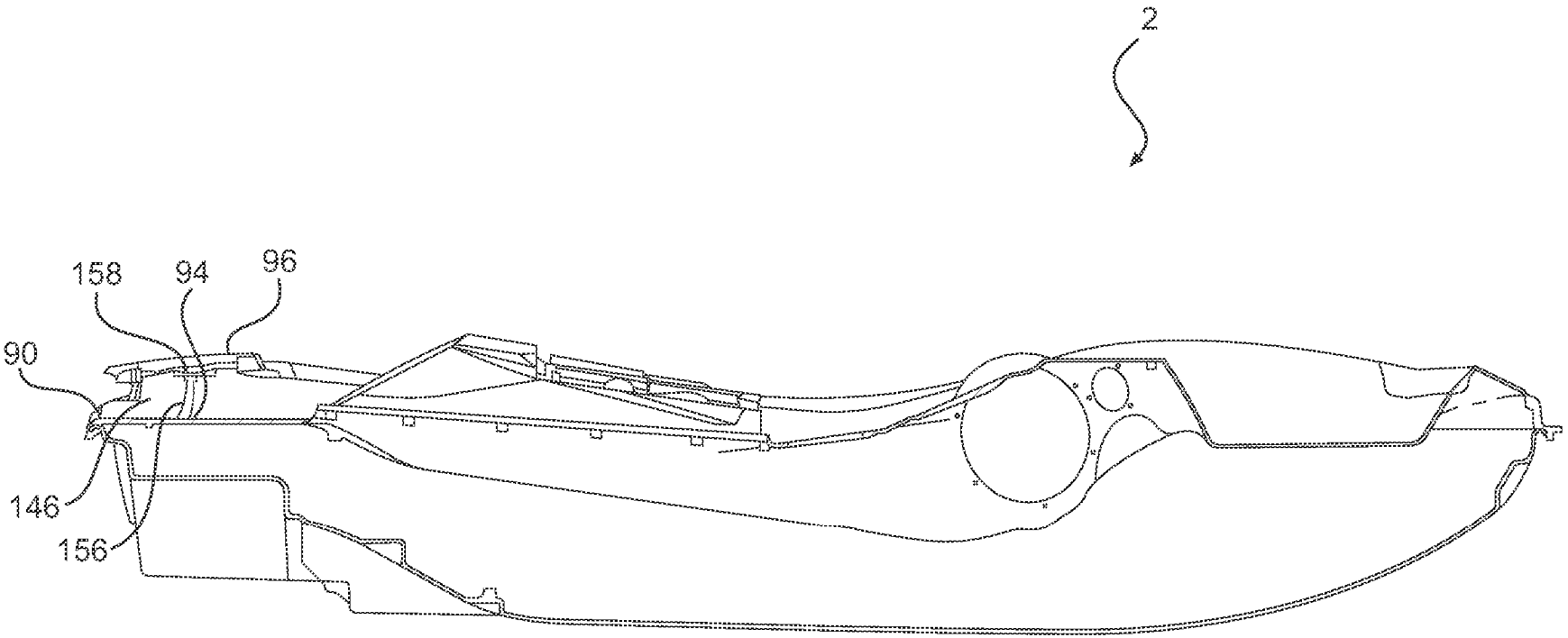
FIG. 15 is a side cross-sectional view of the watercraft of FIG. 1.

Referring now to FIG. 15, the likelihood of water flowing over the rear platform 90 into the side channels 84 can be further reduced by the addition of a check valve in the rear channel 94, in the form of a flap 156 covering the rear channel 94. The top 158 of the flap 156 is hingedly connected to the rear portions 146 of the walls 140. It is contemplated that the top 158 of the flap 156 may alternatively be connected to any other suitable part of the watercraft 2, such as the platform 96. The flap 156 pivots about the hinge axis 160, and the bottom 162 of the flap 156 rests against the bottom wall 154 of the rear channel 94 when the watercraft 2 is at rest. It is contemplated that the bottom 162 of the flap 156 may instead rest on any other suitable portion of the watercraft 2, such as a portion of the rear platform 90. When water accumulated in the side channels 84 flows toward the flap 156 from the inside of the watercraft 2, the force of the water flow causes the flap 156 to rotate about the hinged connection. The rotation of the flap 156 creates an opening 164 through which the water can pass to exit the watercraft over the rear portion 90 of the sub-deck 6. When water from the body of water flows toward the flap 156 from the outside of the watercraft 2, the force of the water flow causes the flap 156 to be pressed against the bottom wall 154 of the rear channel 94, thereby closing the opening 164 and preventing water from entering onto the watercraft 2. It is contemplated that the flap 156 may alternatively be a flexible flap 156 that is attached to the watercraft 2 at its top 158 without being hinged. In this alternative arrangement, when water accumulated in the side channels 84 flows toward the flap 156 from the inside of the watercraft 2, the force of the water flow causes the flap 156 to flex outwardly, thereby creating the opening 164 through which the water can pass to exit the watercraft over the rear portion 90 of the sub-deck 6. When water from the body of water flows toward the flap 156 from the outside of the watercraft 2, the force of the water flow causes the flap 156 to be pressed against the bottom wall 154 of the rear channel 94, thereby closing the opening 164 and preventing water from entering onto the watercraft 2.

Figure 14:
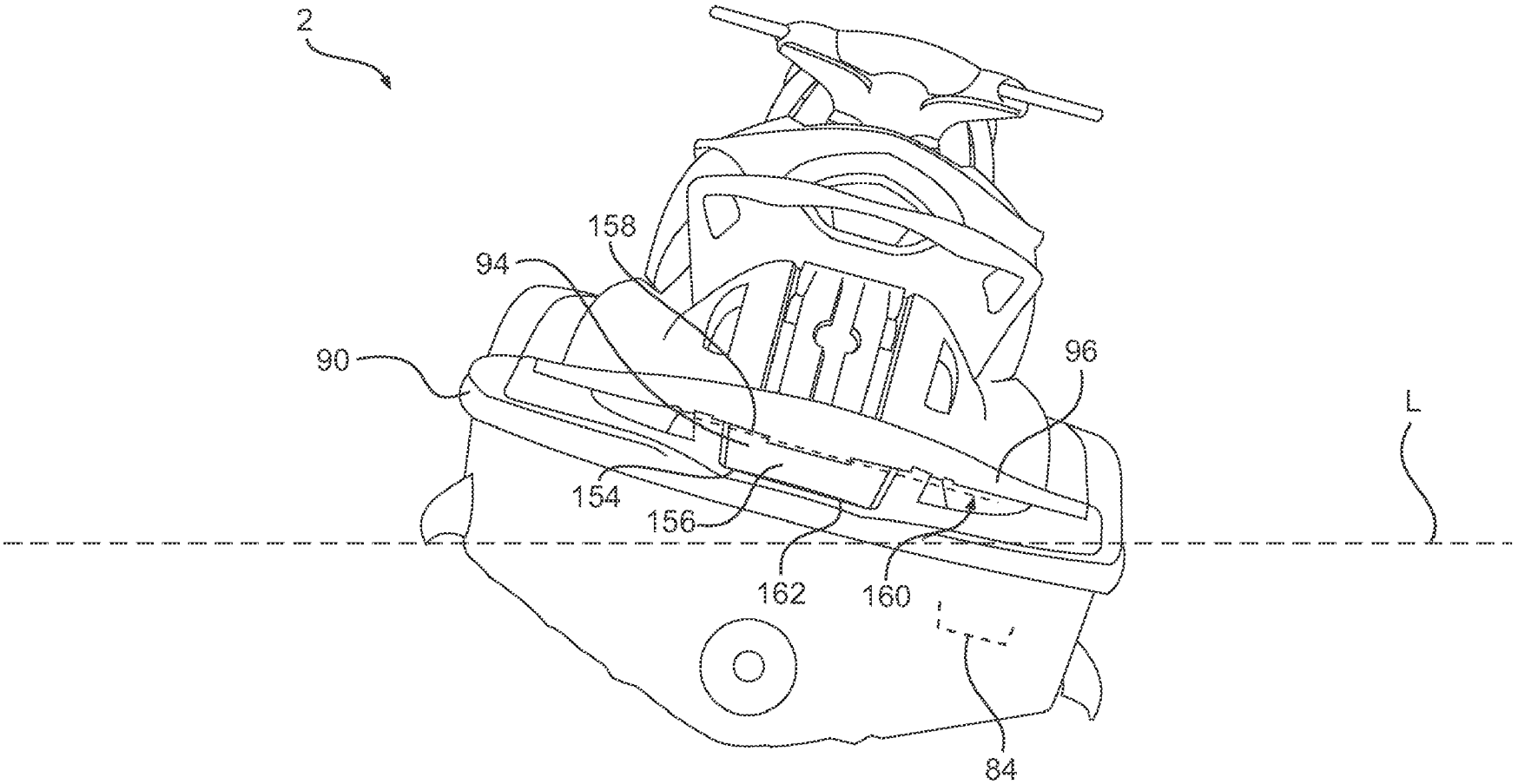
FIG. 14 is a rear elevation view of the watercraft of FIG. 1 as it would appear while turning to the right.

Referring now to FIG. 14, when the watercraft 2 turns it tilts in the direction of the turn. The watercraft 2 is shown tilted to the right, as it would appear while turning to the right. In this position, the right side channel 84 (shown schematically) is disposed even farther below the water level L in the body of water, and is therefore more susceptible to accumulating significant quantities of water. Due to the narrow width W1 of the rear channel 94 and the additional buoyancy created by the flotation volume of the two storage compartments 92, the rear channel 94 remains above the surface of the water when the watercraft 2 is tilted, thereby preventing water from flowing from the body of water into the side channels 84.

Figure 16:
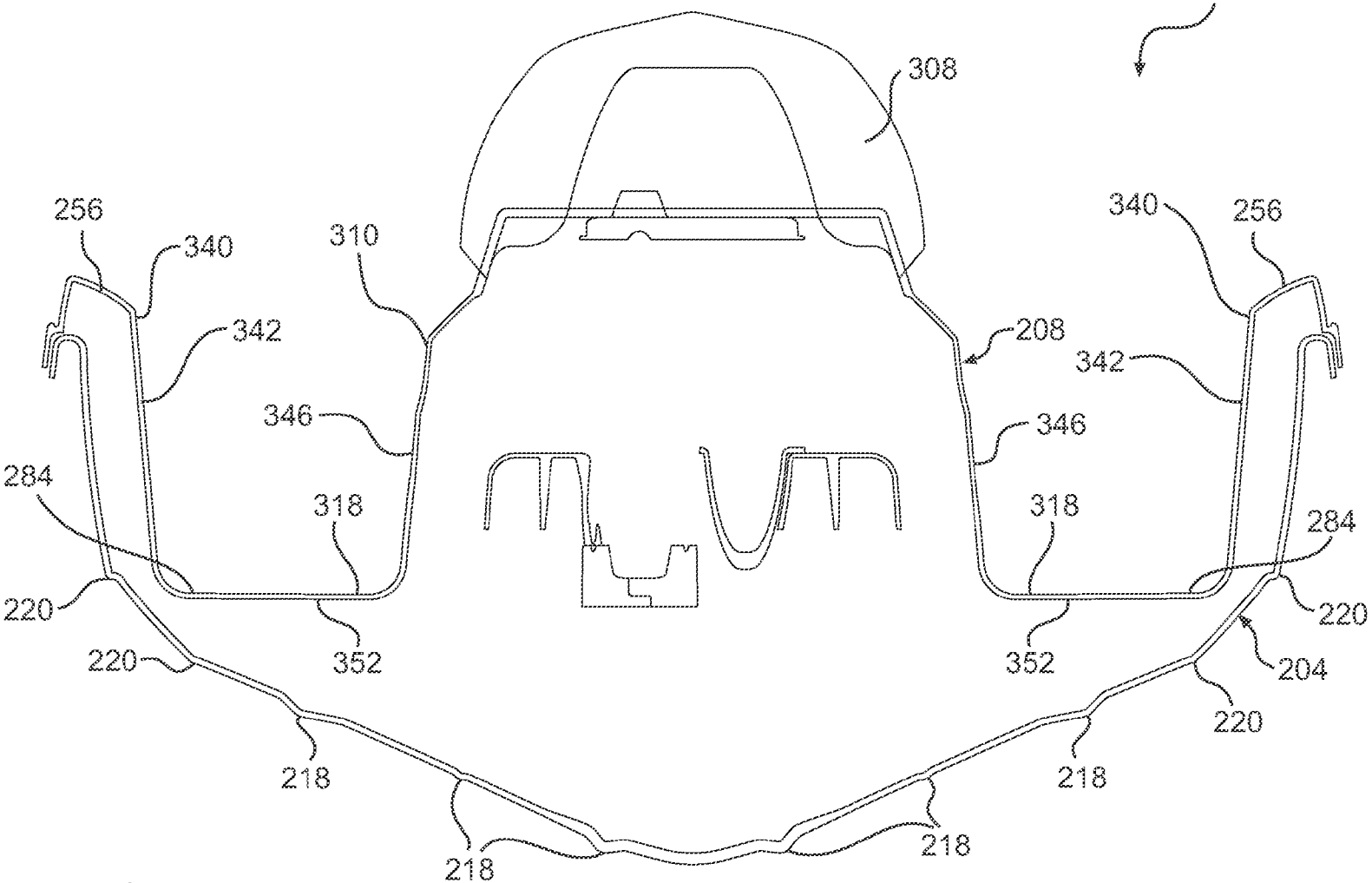
FIG. 16 is a schematic view of a transverse cross-section of a watercraft according to an alternative embodiment of the invention.

Referring now to FIG. 16, a watercraft 202 will be described according to a second embodiment of the invention. Many of the parts of the watercraft 202 are similar to corresponding parts of the watercraft 2, and will not be shown or described in detail. The watercraft 202 appears substantially similar to the watercraft 2 when viewed from the top (FIGS. 5 and 11) with the exception that the watercraft 202 has no seal 120 because the sub-deck 6 and deck 8 of the watercraft 2 are formed integrally as the deck 208 of the watercraft 202.

The watercraft 202 has two main parts. These parts are the hull 204 and the deck 208. The hull 204 and the deck 208 are joined together, preferably by an adhesive, to form the body of the watercraft 202. Rivets or other fasteners may also join the hull 204 and deck 208. Unlike the watercraft 2, the watercraft 202 has no sub-deck between the hull 204 and the deck 208. The volume between the hull 204 and the deck 208 forms the engine compartment, which functions similarly to the engine compartment of the watercraft 2. A pedestal 310 formed in the deck 208 accommodates the internal components of the watercraft 202, such as the engine (not shown), and shields these components from water. The hull 204 is provided with a combination of strakes 218 and chines 220, which respectively function similarly to the strakes 18 and chines 20 of the watercraft 2. The deck 208 has a pair of generally upwardly extending gunnels 256, that function similarly to the gunnels 56 of the watercraft 2.

The deck 208 supports a seat 308 thereon, designed to accommodate a driver and one or more passengers. A centrally positioned straddle-type seat 308 is placed on top of the pedestal 310 to accommodate the driver and passengers in a straddling position. The seat 308 functions similarly to the seat 108 of the watercraft 2, and will not be described in detail. Left and right footrests 318 designed to accommodate the driver's and passengers' feet are disposed on the deck 208 on either side of the pedestal 310, between the pedestal 310 and the gunnels 256. The footrests 318 are formed by the bottom walls 352 of the left and right side channels 284, and are disposed between the respective side walls 346 of the pedestal 310 and the forward portions 342 of the respective inner walls 340 of the gunnels 256. The footrests 318 are preferably covered by carpeting made of a rubber-type material to provide additional comfort and feet traction.

The side channels 284 are formed between the inner walls 340 of the gunnels 256 and the side walls 346 of the pedestal 310. The side channels 284 are substantially the same shape as the side channels 84 of the watercraft 2. The side channels 284 communicate with a rear channel (not shown) rearward of the pedestal, in the same way that the side channels 84 of the watercraft 2 communicate with the recess 86 and the rear channel 94. A rear portion (not shown) of the deck 208 is disposed higher than a bottom of the side channels 284, similarly to the rear portion 90 of the watercraft 2 as seen in FIG. 13. When the watercraft 202 is in use, water that has collected in the side channels 284 drains into the body of water through the rear channel similarly to the rear channel 94 of the watercraft 2.

The watercraft 202 may additionally have a flap (not shown) similar to the flap 156 of the watercraft 2, to prevent water from entering the watercraft 202 via the rear channel 294. The watercraft 202 may additionally have a rear platform (not shown) above the rear channel 294 similar to the rear platform 96 of the watercraft 2. The watercraft 202 may additionally have storage compartments (not shown) on either side of the rear channel 294, similar to the storage compartments 92 of the watercraft 2.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a sub-deck disposed on the hull, the hull and sub-deck together forming a hull and sub-deck (HSD) assembly;

the HSD assembly having upwardly-extending left and right gunnels, the left gunnel having a generally vertical left inner wall, the right gunnel having a generally vertical right inner wall, each inner wall having a forward portion and a rearward portion;

the HSD assembly having a pedestal disposed on a longitudinal centerline of the watercraft, the pedestal being disposed generally between the forward portion of the left inner wall and the forward portion of the right inner wall;

the pedestal having a generally vertical left lateral wall and a generally vertical right lateral wall, the left lateral wall and the right lateral wall defining therebetween a width of the pedestal;

an engine disposed in the HSD assembly;

a propulsion system connected to the hull and operatively connected to the engine;

a helm assembly operatively connected to the propulsion system;

a straddle-type seat disposed above the pedestal of the HSD assembly at least in part rearwardly of the helm assembly;

a left side channel defined between the left lateral wall of the pedestal and the forward portion of the left inner wall;

a right side channel defined between the right lateral wall of the pedestal and the forward portion of the right inner wall;

a rear channel defined between the rearward portion of the left inner wall and the rearward portion of the right inner wall, the rear channel being disposed rearwardly of the pedestal on the longitudinal centerline of the watercraft, the rear channel being generally symmetric about the longitudinal centerline of the watercraft;

a width of the rear channel being narrower than a maximum width of the pedestal; and a rear platform connected to a rear portion of the HSD assembly, the rear platform extending laterally across the rear portion of the HSD assembly above the rear channel.

2. The personal watercraft of claim 1, wherein the width of the rear channel is narrower than a minimum width of the pedestal.

3. The personal watercraft of claim 2, further comprising:

a left storage compartment disposed to the left of the rear channel and rearward of the left side channel; and a right storage compartment disposed to the right of the rear channel and rearward of the right side channel.

4. The personal watercraft of claim 3, wherein:

the rear channel has a generally horizontal bottom wall; and the left and right storage compartments are disposed at least in part higher than the bottom wall of the rear channel.

5. The personal watercraft of claim 1, wherein:

the left side channel has a generally horizontal bottom wall;

the right side channel has a generally horizontal bottom wall;

the rear channel has a generally horizontal bottom wall; and the bottom wall of the rear channel is higher than the bottom walls of the left and right side channels.

6. The personal watercraft of claim 5, wherein when the personal watercraft is placed in water at rest and with no load placed thereon, the bottom walls of the left and right side channels are below a waterline of the watercraft; and the bottom wall of the rear channel is above the waterline of the watercraft.

7. The personal watercraft of claim 6, further comprising a deck disposed above the sub-deck, wherein the straddle-type seat is disposed on the deck.

8. The personal watercraft of claim 7, wherein the deck has left and right footrests disposed laterally outwardly of the seat, the left footrest being disposed in the left side channel above the bottom wall of the left side channel and the right footrest being disposed in the right side channel above the bottom wall of the right side channel.

9. The personal watercraft of claim 7, further comprising a suspension element having a first portion connected to the deck and a second portion connected to the HSD assembly, the suspension element permitting relative movement between the deck and the HSD assembly.

10. The personal watercraft of claim 1, wherein the HSD assembly further comprises a recess forward of the side channels, the recess providing fluid communication between the side channels therethrough.

11. The personal watercraft of claim 1, further comprising a check valve disposed in the rear channel, the check valve permitting water to flow out from the watercraft via the rear channel, the check valve preventing water from flowing onto the watercraft via the rear channel.

12. A personal watercraft comprising:

a hull;

a deck disposed on the hull, the deck and the hull defining therebetween an engine compartment;

the deck having upwardly-extending left and right gunnels, the left gunnel having a generally vertical left inner wall, the right gunnel having a generally vertical right inner wall, each inner wall having a forward portion and a rearward portion;

the deck having a pedestal disposed on a longitudinal centerline of the watercraft, the pedestal being disposed generally between the forward portion of the left inner wall and the forward portion of the right inner wall;

the pedestal having a generally vertical left lateral wall and a generally vertical right lateral wall, the left lateral wall and the right lateral wall defining therebetween a width of the pedestal;

an engine disposed in the engine compartment;

a propulsion system connected to the hull and operatively connected to the engine;

a helm assembly operatively connected to the propulsion system;

a straddle-type seat disposed above the pedestal at least in part rearwardly of the helm assembly;

a left side channel defined between the left lateral wall of the pedestal and the forward portion of the left inner wall;

a right side channel defined between the right lateral wall of the pedestal and the forward portion of the right inner wall;

a rear channel defined between the rearward portion of the left inner wall and the rearward portion of the right inner wall, the rear channel being disposed rearwardly of the pedestal on the longitudinal centerline of the watercraft, the rear channel being generally symmetric about the longitudinal centerline of the watercraft;

a width of the rear channel being narrower than a maximum width of the pedestal; and a rear platform connected to a rear portion of the deck, the rear platform extending laterally across the rear portion of the deck above the rear channel.

13. The personal watercraft of claim 12, wherein the width of the rear channel is narrower than a minimum width of the pedestal.

14. The personal watercraft of claim 13, further comprising:

a left storage compartment disposed to the left of the rear channel and rearward of the left side channel; and a right storage compartment disposed to the right of the rear channel and rearward of the right side channel.

15. The personal watercraft of claim 14, wherein:

the rear channel has a generally horizontal bottom wall; and the left and right storage compartments are disposed at least in part higher than the bottom wall of the rear channel.

16. The personal watercraft of claim 12, wherein:

the left side channel has a generally horizontal bottom wall;

the right side channel has a generally horizontal bottom wall;

the rear channel has a generally horizontal bottom wall; and the bottom wall of the rear channel is higher than the bottom walls of the left and right side channels.

17. The personal watercraft of claim 16, wherein when the personal watercraft is placed in water at rest and with no load placed thereon, the bottom walls of the left and right side channels are below a waterline of the watercraft; and the bottom wall of the rear channel is above the waterline of the watercraft.

18. The personal watercraft of claim 17, wherein the deck has left and right footrests disposed laterally outwardly of the seat, the left footrest being disposed in the left side channel and the right footrest being disposed in the right side channel.

19. The personal watercraft of claim 12, further comprising a check valve disposed in the rear channel, the check valve permitting water to flow out from the watercraft via the rear channel, the check valve preventing water from flowing onto the watercraft via the rear channel.

* * * * *